United States Patent [19]

Duran et al.

[11] Patent Number: 4,733,925

[45] Date of Patent: Mar. 29, 1988

[54] DEVICE FOR THE SUSPENDED ARRANGEMENT OF JUXTAPOSED INDIVIDUAL TILTING COMPARTMENTS

[76] Inventors: Gilbert Duran; Yves Clement, both of 48 rue des Abbesses, 75018 Paris; Michel Garcia, 2 place de l'Hotel de Ville, 47800 Miramont de Guyenne, all of France

[21] Appl. No.: 860,892

[22] Filed: May 8, 1986

[30] Foreign Application Priority Data

Nov. 5, 1985 [EP] European Pat. Off. ..... 85450025.3

[51] Int. Cl.[4] ..... A43F 5/08

[52] U.S. Cl. ..... 312/248; 312/328

[58] Field of Search ..... 312/245, 246, 247, 248, 312/212, 326, 327, 328, 251, 338; 108/42, 50, 149; 211/116, 168, 169, 88

[56] References Cited

U.S. PATENT DOCUMENTS

| | | | |
|---|---|---|---|
| 1,684,913 | 9/1928 | Flannery | 312/328 X |
| 1,894,185 | 1/1933 | Martin | 211/88 |
| 2,420,011 | 5/1947 | Paxton et al. | 312/328 X |
| 2,809,085 | 10/1957 | Fall | 312/238 X |
| 3,162,497 | 12/1964 | Boswinkle et al. | 312/248 |
| 3,427,086 | 2/1969 | Action | 312/245 |
| 4,155,312 | 5/1979 | Thorkildson | 108/137 |
| 4,275,942 | 6/1981 | Steidl | 312/247 X |

FOREIGN PATENT DOCUMENTS

| | | |
|---|---|---|
| 1301258 | 7/1960 | France . |
| 2109582 | 5/1972 | France . |

*Primary Examiner*—Joseph Falk

*Attorney, Agent, or Firm*—Robert J. Koch

[57] ABSTRACT

A suspended arrangement of juxtaposed individual tilting compartments, made of a plurality of shelving compartments, each placed onto a flat, rectangular or square panel articulated around an axle parallel to one of its longitudinal sides and in the vicinity of the latter, on two pieces fixedly mounted on two lateral ends of the panel, with means being provided to lock the panels in the horizontal position and to limit their opening in the downward direction essentially to the vertical, the panels are aligned side by side at very small distances, without any stationary structural elements being interposed between them in the direction of their orthogonal alignment with the tilting axles.

12 Claims, 9 Drawing Figures

DEVICE FOR THE SUSPENDED ARRANGEMENT OF JUXTAPOSED INDIVIDUAL TILTING COMPARTMENTS

BACKGROUND OF THE INVENTION

1. Field of the Invention

The present invention concerns a device for the suspended arrangement of juxtaposed individual compartments so as to constitute a total array volume that may be combined at will and occupies all or part of the upper edge of a volume of a room, a desk and generally of any enclosed space.

It is the object of the invention to provide a shelving system that may be composed at will of individual compartments and is adaptable to any configuration of the space to be thus equipped, in a particularly esthetic manner and without the need for initially constructing a heavy holding structure, such as a false ceiling or a mezzanine, for example.

2. Description of the Related Technology

From FR-No. 1,301,258 a kitchen layout consisting of placing various items of furnishings above an existing false ceiling by suspending them from or attaching them to the upper face of an articulated trap door along the edge of an opening provided for the purpose in the wall of said false ceiling is already known.

The elements of furnishings are permanently attached to said trap door so that the system cannot be used for arranging individual objects. It may be installed only if a false ceiling is already in place or one is specially constructed, and in addition it requires tedious work and is not very practical, as an opening in the wall of the false ceiling must be made at the location wherein the assembly is to be placed and the axles of articulation of the trap door must be installed, together with locking means and counter weights, on the periphery of said opening and the upper face of the false ceiling.

Furthermore, in the modes of embodiment shown in the aforecited reference, the plane of the trap door in the closed position is located above the said opening rendering it clearly visible and unattractive in appearance, while the locking means (handle) necessarily projects downward from the false ceiling, thereby contributing to the unpleasant appearance of the layout.

SUMMARY OF THE INVENTION

The present invention is based on the general concept suggested by said reference of utilizing the upper part of a given volume to arrange a plurality of objects therein and providing access to them by means of a tilting system, and proposes a device which eliminates the aforementioned disadvantages, offers a very wide diversity of possible adaptations to all types of access and objects and makes it possible to occupy to the maximum extent a given space, while preserving the appearance of the location.

The object of the present invention is therefore a device for the suspended arrangement of juxtaposed individual tilting compartments, characterized in that it comprises a plurality of shelving compartments, each placed on the upper face of a flat, rectangular or square panel, articulated around an axle parallel to one of the longitudinal sides and in the vicinity of the latter, on two pieces fixedly mounted on the two lateral ends of the panel, with means being provided for the locking of the panels in the horizontal position and limiting their opening in the downward direction essentially to the vertical, the panels being aligned side by side in one or two directions while being parallel to each other at a very small distance, without any stationary structural element being interposed between them in a direction of alignment orthogonal to the tilting axes.

Such a device constitutes a multiple shelving structure that may be combined at will as it is capable of expanding in two orthogonal directions to form by virtue of its single lower face of the panels placed adjacent to each other in a checker pattern rows of compartments, without projections or recesses, thereby themselves constituting a false ceiling which is both pleasing in appearance and functional.

The fixedly mounted pieces providing the articulation are for example stationary pieces fastened arbitrarily along angle pieces, supports or the like, which in turn are fastened parallel to each other to parallel vertical walls, between which the arrangement device according to the invention is to be mounted or suspended from an upper structure (ceiling, girders, etc.) or else suspended on one side of the row of compartment and secured on a wall on the other side of the compartments.

Between two of these angles supports the number of compartments desired may be aligned side by side and by providing three of such angle supports preferably in parallel, the compartments may be aligned in two directions parallel to the sides of the panels.

A small gap is provided between each of the panels, just large enough for the partial insertion of a hand to grip the longitudinal edge opposite to the edge in the vicinity of which the panel is articulated, for the manipulation of the compartment, an appropriate lock/release system being provided between each panel and the said angle supports. In this manner, the pleasing appearance of the bottom face of the arranging device is not altered by projecting elements, as the thin slits at the separations between the various panels break the smooth and continuous surface harmoniously and may be provided on the inside with flexible colored or colorless flaps masking the openings without hindering the passage of the hand.

BRIEF DESCRIPTION OF THE DRAWINGS

Further characteristics and advantages will become apparent from the description hereinbelow of the modes of embodiment of the device according to the invention given as an example only and with reference to the drawings attached hereto, wherein.

DETAILED DESCRIPTION OF THE PREFERRED EMBODIMENT

Figure 1:
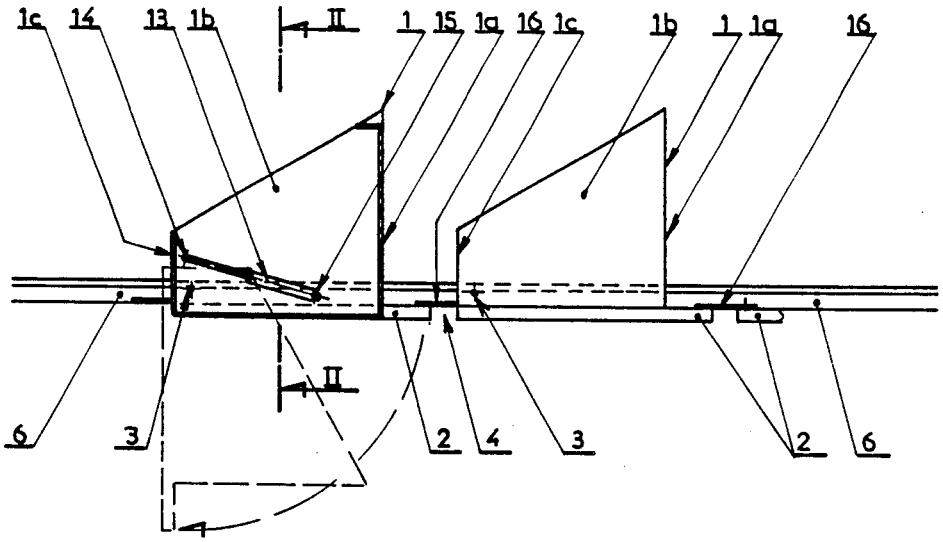
FIG. 1 shows schematically a lateral view of two successive compartments of an arrangement device according to the invention.
Figure 2:
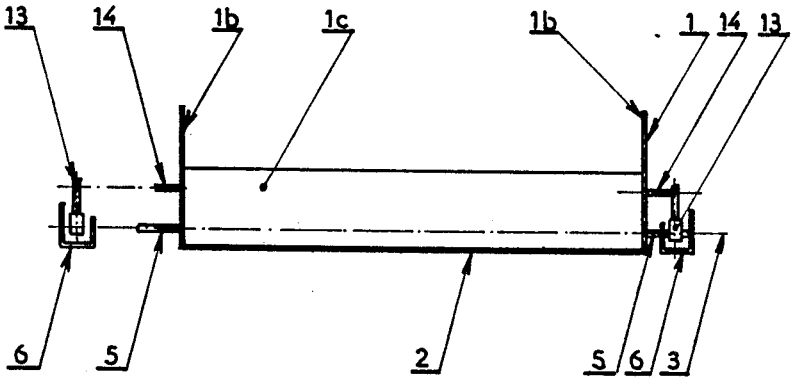
FIG. 2 is a sectional view on the line II—II of the device of FIG. 1.

The device of the invention shown schematically in principle in FIGS. 1 and 2 is a series of individual units in a row comprising compartments or containers to hold different objects, designated by the general symbol 1 and placed onto the upper surface of a flat, rectangular, or square panel 2.

Figure 3:
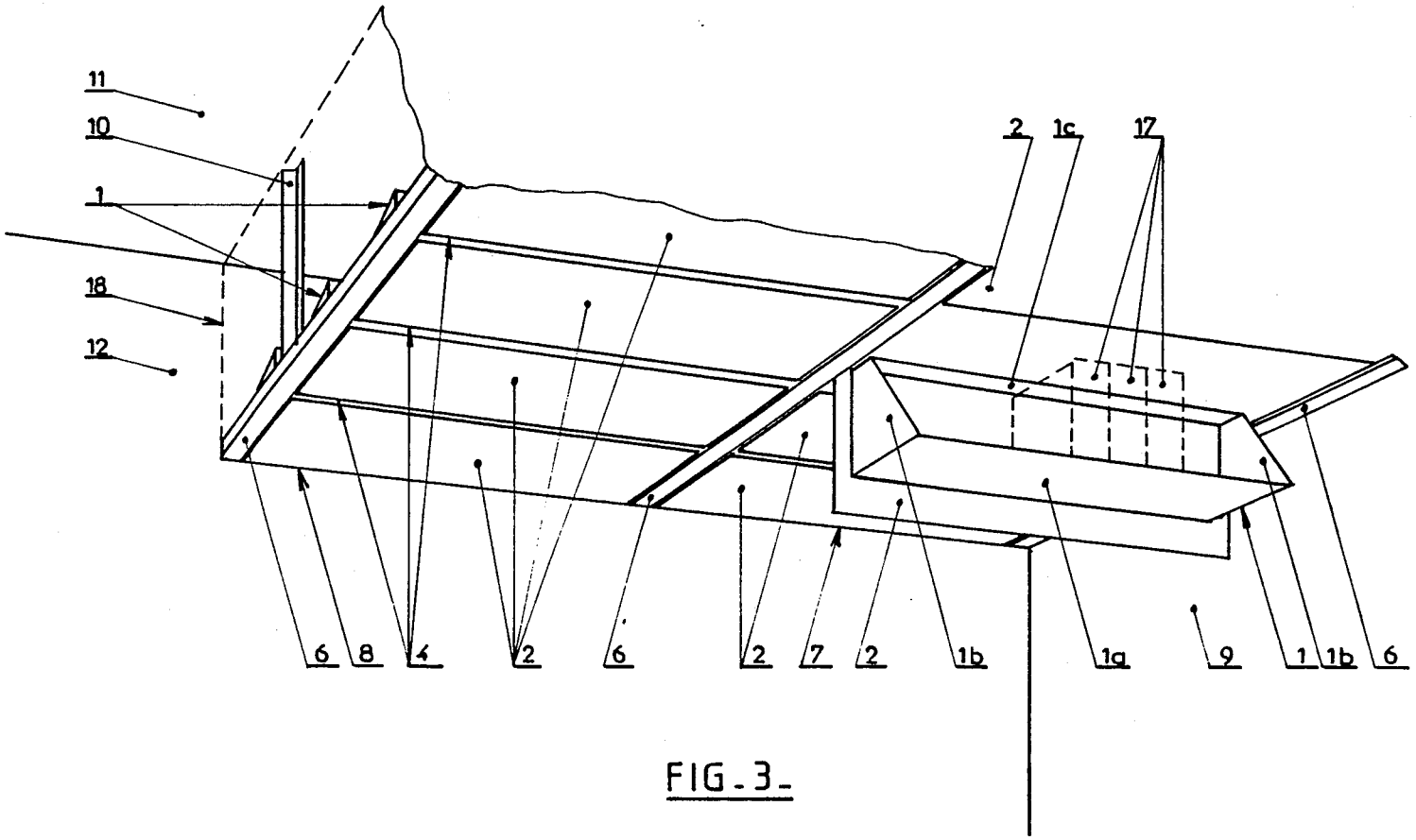
FIG. 3 is a perspective view of the bottom of a device according to the invention.

The bottom of the compartment 1 comprises either the panel 2 itself, or a plate which is an integral part of the compartment. The lateral walls of the compartment may have variable forms and dimensions. In the embodiment of FIGS. 1 and 3, a front wall 1*a* is provided. The wall is vertical when the panel is in a horizontal closed position (FIG. 1) and passing essentially into its horizontal position during the tilting of the compartment, then serving as the support of objects aligned in the manner shelving (FIG. 3).

The wall 1*a* is flanked by two lateral walls 1*b* generally of a trapezoidal configuration and placed parallel to the short sides of the panel 2, immediately adjacent to the latter.

A top wall 1*c* completes the compartment 1.

The compartment 1 and the panel 2 are made of an appropriate material, such as wood, plastic, metal, etc. The constituent walls 1*a* to 1*c* of the compartment 1 may be solid or open mesh or may consist simply of bars or the like.

Each assembly 1-2 is articulated around an axle 3, parallel to the longitudinal sides of the compartments and located preferably in the immediate vicinity of one of the longitudinal sides.

The several tilting axles 3 of the compartments 1 are parallel and horizontal and sufficiently close to each other so that there is a gap 4 between two successive compartments, between the edges with respect to two panels 2, just sufficient to permit the free passage of the assembly 1-2 during the downward tilting of said assembly without engaging the edge of the adjacent panel 2, and to permit the at least partial engagement of a hand to pull the assembly 1-2 down.

The assembly 1-2 is equipped laterally (FIG. 2) with two bearing journals 5 defining the said tilting axle 3 and held in two lateral pieces 6 provided with suitable bearing seats. In FIGS. 1 and 2 the said pieces 6 are common to the different compartments and consist of two metal angles placed horizontally and parallel on either side of the compartments 1.

The angles 6 are provided successively with seats permitting the rotation of the journals 5 of the several compartments of the row.

The angles 6 are either suspended by suitable suspension posts from an existing structure, a ceiling, girders, etc., or attached directly to a vertical wall.

In the embodiment shown in FIG. 3, two parallel alignments 7 and 8 of the compartments are shown One (7) is attached to a wall 9 to which one of the angles 6 is fastened by any suitable means, with the other angle 6 being suspended. The other alignment (8) utilizes this suspended angle and rests on the other side on another angle 6 suspended, for example by suitable suspension posts 10, from the ceiling 11 of the room, with the angles 6 optionally also being embedded in the wall 12 perpendicular to the walls 9 and 11.

Preferably, the journals 5 are engaged in distinct receptacle pieces of the angles, said pieces being displaceable and thus capable of being positioned freely along the angles, which may comprise metal, wood or a plastic, and the forms and dimensions whereof may vary. They may be for example simple laths or shapes with a rectangular cross section, to the upper faces of which the said receptacle pieces are attached by any appropriate means. The latter also carry counter weight means, such as gas lift levers as shown at 13 in FIG. 1.

In FIG. 1, the gas lift levers 13, the principle and operation of which are well known, are placed on the flanks of each compartment 1 and on the outside, while being anchored on the one hand on the compartment at a point 14 located in the vicinity of the tilting axle 3, and on the other, on the two angle supports 6 flanking the compartment at a point 15 which is relatively far from the axle 3.

The receptacle pieces also carry locking elements for the panel 2 in the horizontal position cooperating with the complementary elements fastened to the panel 2.

Figure 4:
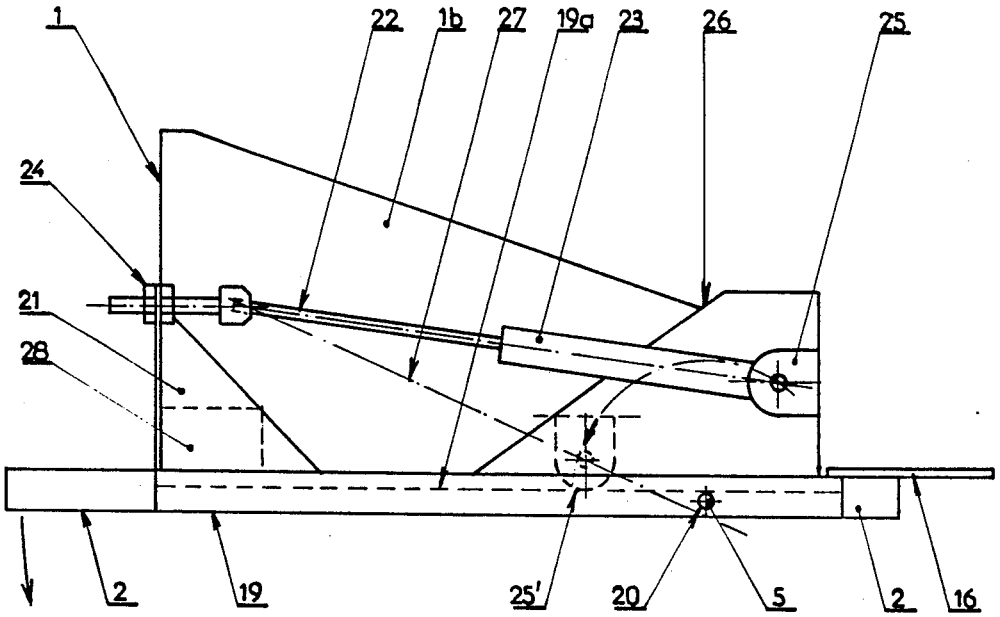
FIG. 4 is a lateral elevation of an embodiment of the means for the articulation, counter balancing and locking of the compartments.
Figure 5:
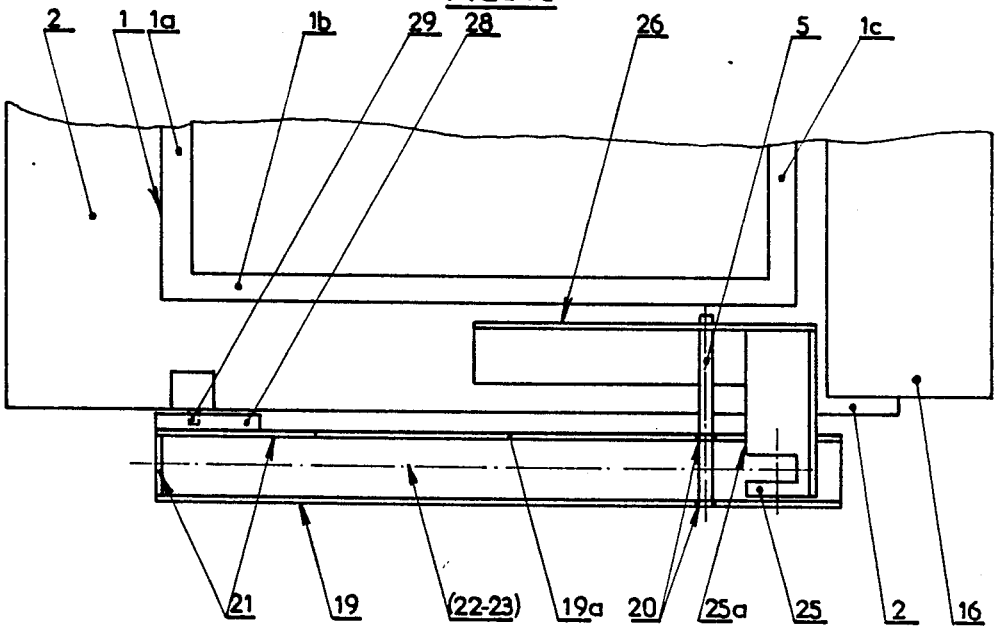
FIG. 5 is a top view of the device of FIG. 4.

FIGS. 4 and 5, to be described below, illustrate an embodiment of the device according to the invention comprising receptacle pieces upon which the means of articulation, weight compensation and locking for each compartment are mounted.

As seen in FIG. 3, the shelving compartments may be aligned in two orthogonal directions so as to cover all or part of the ceiling 11 as desired and according to need, with the bottom faces of the panels 1, in the raised position, defining a practically continuous, flat horizontal surface, in a manner such that the panels 2 themselves constitute a kind of false ceiling masking in an esthetically pleasing manner the shelving space occupying nearly all of the volume enclosed between the ceiling 11 and the plane of the panels 2.

The narrow slits (intervals 4) between the panels 2 are uniformly distributed over the surface of such a false ceiling and provide a certain esthetic note. The slits are advantageously masked for example by a flexible flap 16 (FIG. 1) attached to the top face of each panel 2, along the longitudinal side adjacent to the axle 3 and extending above the edge with regard to the adjacent panel 2. This flap 16 makes possible the free passage of a hand to grip the free edge of the panel 2 covered by said flap.

FIG. 3 shows for example file folders indicated by the broken line 17 resting in the open position of the compartment on the horizontal tray 1*a* and which are perfectly retained inside the compartment both in the tilted and the shelving position.

In the case of the installation of the device of the invention in a hallway, the angle supports 6 are mounted directly on the walls facing the hallway.

The suspension posts 10 of the outer angle support 6 are masked by a built-up lateral fascia indicated by the broken line 18 in FIG. 3.

FIGS. 4 and 5 show an embodiment of the means for the articulation, weight compensation and locking of the shelving compartments.

These means are grouped and supported on each side of the compartment by a metal piece 19 in the form of a U-shape having a length slightly less than the width of the panel 2. The supports 19 are provided with holes making it possible to attach them in any location along the stationary mounting and suspension elements of the compartments, such as the angle supports 6 or other devices made of wood, plastics, etc., performing the same function.

The support 19 is provided in the vicinity of one of its ends with holes 20 to receive one of the journals 5 of the compartment (1, 2). At its other end, the support 19 carries a piece 21 to anchor the end 22 of the rod of a gas lift lever 23. A system of screws and nuts 24 makes it possible to regulate the distance of the end of the road 22 relative to the anchoring piece 21.

The other end of the gas lever 23 is anchored on a strap 25 attached laterally to an angle bracket 26 integral with the panel 2, at the side and outside of the compartment 1.

One of the flanks (25*a*) of the strap 25 serves as a stop to limit the tilting path of the assembly 1, 2 when abutting against the edge of the vertical inner wing 19*a* of the angle support 19, as shown at 25 in FIG. 4. In the closed position of the compartment, the axis of the lever 23 (FIG. 4) is clearly above the line connecting the journal 5 with the end of the rod 22. The lever 23 tends to return the assembly 1,2 in the upward direction. By applying a force F to the free edge of the panel 2 to tilt it downward, the lever 23 is compressed. When the panel is almost vertical (1*a*), the axis of the lever (broken line 27) passes under the line connecting the journal 5 with the end of the rod 22. The lever 23 then urges the assembly 1,2 downward. The movement is arrested by the contact between the part 15*a* and the wing 19*a* and essentially corresponds to the vertical position of the panel 2. The opening of the adjacent compartments is not interfered with.

The tension of the lever 23 is easily controlled by the two systems 24, which are readily accessible in the open position of the compartment. This regulation is a function of the weight of the objects shelved and the maximum force that must be produced for the manipulation of the compartment.

For the sake of clarity on the open compartment of FIG. 3, the means shown in FIGS. 4 and 5, placed to the right of the terminal sides 1*b*, are not indicated.

The locking of the panel 2 in the closed position is advantageously assured by two bolts 28 fastened to the inner face of the two angle supports 19 flanking each compartment and actuated by two projections 29 mounted on the panel 2 on its lateral edges.

Figure 6:
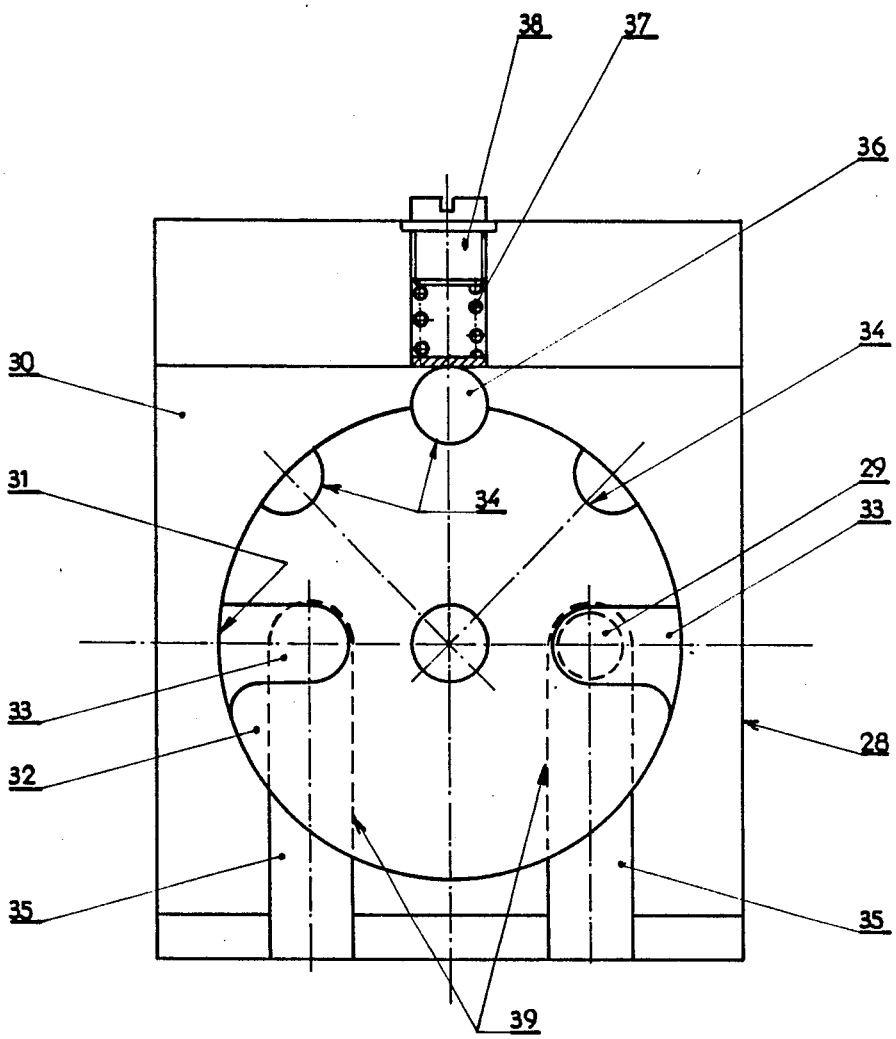
FIG. 6 is a view of the embodiment of the locking means of the compartments.

FIG. 6 illustrates such a bolt, the structure of which is particular. The bolt comprises a stationary plate 30 provided with a cylindrical recess 31 in which a disk 32 rotates freely, said disk comprising two diametrically opposed notches 33 and three hemispherical holes 34.

The notches 33 may be moved to respectively face the two guide grooves 35 provided in the plate 30 by rotating the disk 32 in its recess.

The holes 34 may be moved, again by rotating the disk, to face a positioning ball 36 pressured by a spring 37 that may be regulated by a screw 38.

The disk 32 is maintained in the plate 30 by a cover plate, of which in FIG. 6 the two notches (broken line 39) for the passage of the projection 29 are simply shown, said notches making it possible for the projection to engage one of the grooves 35 and the corresponding notch 33, when the latter is facing said groove 35.

FIG. 6 shows the system in the locking position in which the projection 29 is retained in a notch 33 offset by 90° with respect to its associated groove 35.

Locking is assured by the ball 36 in the center hole 34. By pulling the projection downward to open the shelving compartment, the disk 32 is pivoted while expelling the ball 36 against the spring, the tension of which determines the force to be applied to open the compartment.

The notch 33 is aligned with its associated groove 35, with the blockage in this position being ensured by the insertion of the ball 36 into the left hole 34 which is in the front of the ball.

The projection 29 escapes from the plate 30 and the compartment opens, with the movement being controlled by two gas lift levers.

The bolt 28 comprises two notches 33 with the attached elements (34, 35) placed symmetrically, which makes it possible to use a single form of the bolt to equip the two opposing sides of the same compartment without having to provide mounting means for the elements 28 and 29 in different locations on their respective supports (1, 19) on either side of the compartment. One of the notches 33 is used on one side and the other on the other side, with the two bolts being strictly aligned with each other.

According to a variant of embodiment, the compartments may be provided in an expandable form to permit their adaptation in a more flexible manner to different configurations or applications. Thus, the compartment part 1 proper may be displaceable and have a structure making it possible to modify the length of the compartment.

Figure 7:
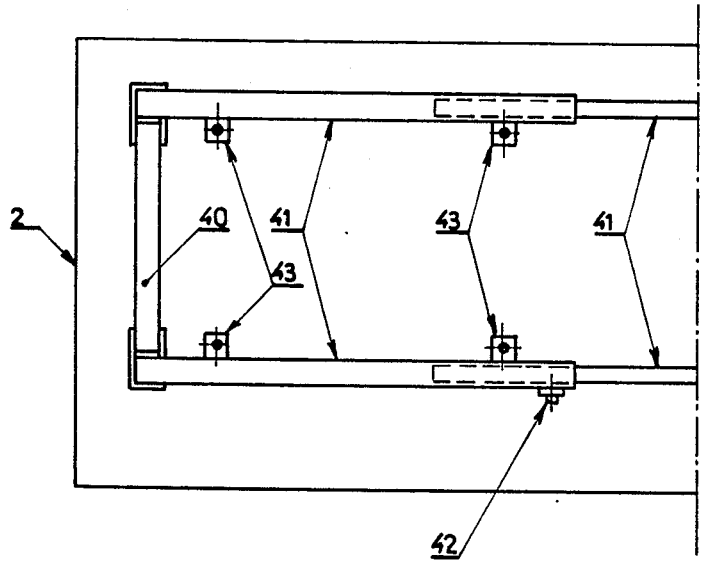
FIG. 7 is a partial top view of the telescopic structure of compartments.
Figure 8:
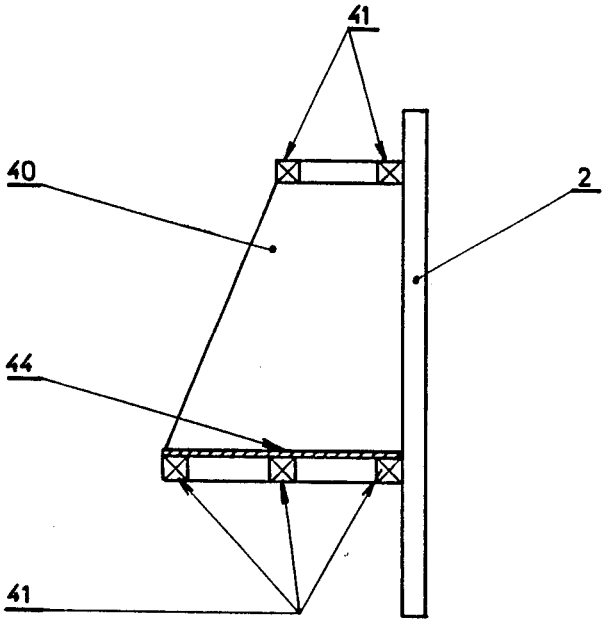
FIG. 8 is a vertical section of the structure of Fig. 7.
Figure 9:
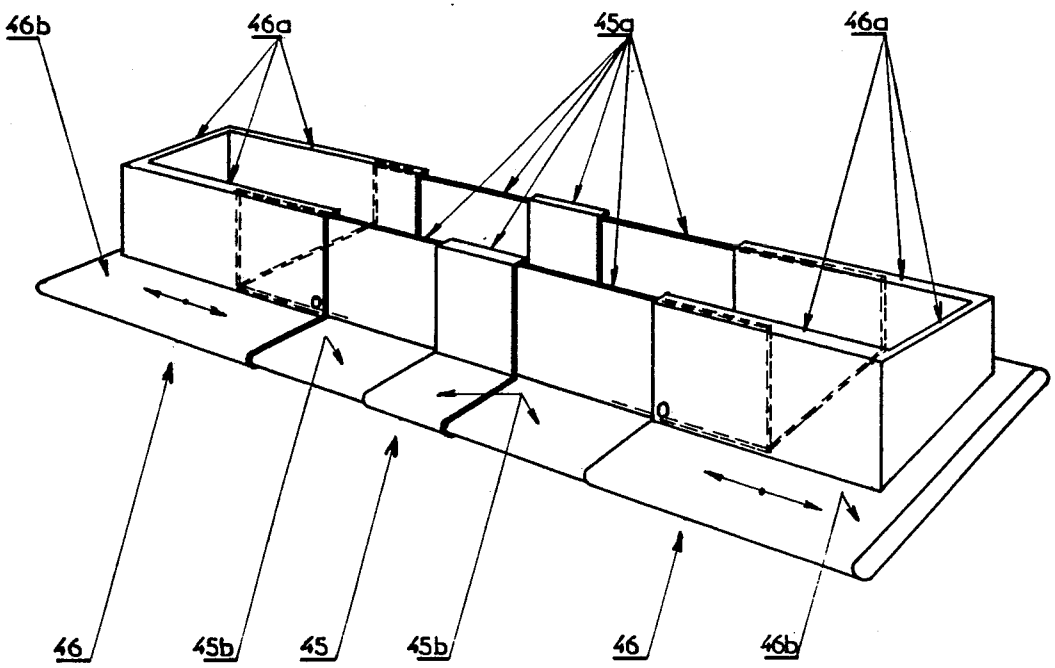
FIG. 9 is a perspective view of a further telescopic structure of the compartments according to the invention.

FIGS. 7 and 9 show such a structure. The compartment comprises two solid end panels 40, corresponding to the sides 1*b* of FIG. 1, joined together by a telescopic structure formed by the tubes 41, which are nesting and sliding within each other. The number, cross section and placement of the tubes are variable. They comprise conventional means 42 (lock screws, for example) for their mutual fixation in the position desired and conventional fastening means 43 (for example, screw tabs) on the inner face of a panel 2, similar to those of FIG. 1.

The tubes 41 corresponding to the side 1*a* to FIG. 1 may be equipped with a small board 44 for example to provide a continuous surface.

A telescopic structure of this type is easily adapted to different dimensions of the panels 2.

FIG. 9 shows a more elaborate variant wherein the compartment 1-panel 2 assembly, which has a telescopic structure and may thus be adapted to different spaces between two angle supports such as 6.

For the purpose, the device comprises a center part 45 upon which two lateral parts 46 are sliding. Each of the elements 45 and 46 comprise a part forming the compartment (45*a*, 46*a*) and a part forming the panel (45*b*, 46*b*). The assembly is such that the structures of the parts 46*a* and 46*b* are hollow and more or less cover the structures of the parts 45*a* and 45*b* by sliding, so as to regulate the length of the general panel (consisting of 45*b* and 46*b*) and of the compartment as desired. Blocking means are provided to lock said elements in the position desired. It should be understood that the external ends of the elements 46*b* are equipped similarly to the panels 2 of the preceding modes of embodiment to make possible the articulation, weight compensation and locking of the shelving compartment.

We claim:

1. A device for suspended arrangement of juxtaposed individual tilting compartments comprising:

two stationary support rails;

means for horizontally mounting said support rails;

a plurality of horizontally aligned shelving compartment units arranged between said support rails each compartment unit comprising a rectangular, normally horizontal panel, and a fixed axle extending between said stationary support rails, means, connected to said stationary support rails, for mounting each of said compartment units between said stationary support rails in an articulated fashion around said axle;

means for locking said compartment units wherein said panel is aligned in a horizontal position and limiting rotation of said compartment units to an alignment where said panel is substantially vertically arranged, connected to each compartment unit;

wherein said panels are coplanar and arranged side by side at a very small distance.

2. A device according to claim 1, wherein each compartment exhibits perforated walls disposed against said panel.

3. A device according to claim 2, wherein each compartment unit includes a telescopic structure for adjusting axial length of said compartment unit.

4. A device according to claim 3, wherein the compartment unit further comprises a center part and two opposing terminal parts adjustably mounted on said center part wherein said center part and said terminal parts constitute compartment unit walls and said panel.

5. A device according to claim 4, wherein said support rails are angle supports directly attached to vertical walls.

6. A device according to claim 4, further comprising angle members connected to said support rails exhibiting a length smaller than the width of the panel and attached pivotally to said axle and carrying said means for mounting and means for locking.

7. A device according to claim 6, further comprising means for compensation of weight exhibiting a gas lift lever placed between the compartment unit and the angle member in a manner such that at the completion of the opening of the panel the lever inverses its compensating and maintains the panel in a vertical position in abutment against the angle member.

8. A device according to claim 6 wherein said means for locking comprises:

a first and second catch disposed on each support rail in opposing fashion associated with each compartment unit each exhibiting a rotating disk mounted in a housing arranged with a guide slot, said disk exhibiting a notch and movable between a first position where said disk blocks a travel path of said guide slot and a second position where said notch is aligned with a travel path of said guide slot and a ball system means for elastic retention of rotational alignment of said disk; and a first and second projection disposed on opposing lateral ends of said compartment units aligned with said guide slots of a respective catch.

9. A device according to claim 8, wherein each disk exhibits two diametrically opposed notches.

10. A device according to claim 4, wherein said pieces mounted fixedly on the lateral ends of the panel are angle supports suspended from an upper structure.

11. A device according to claim 1, wherein each panel further comprises a masking flap to conceal a space between two successive compartments to the right of a longitudinal edge near the tilting axle of the compartment.

12. A device according to claim 1, wherein the compartment unit exhibits solid walls disposed against said panel.

* * * * *